US008272297B1

(12) United States Patent
Chen

(10) Patent No.: US 8,272,297 B1
(45) Date of Patent: Sep. 25, 2012

(54) EASY TO ASSEMBLE RATCHET WRENCH

(76) Inventor: Kuo Lung Chen, Taichung (TW)

( * ) Notice: Subject to any disclaimer, the term of this patent is extended or adjusted under 35 U.S.C. 154(b) by 0 days.

(21) Appl. No.: 13/234,112

(22) Filed: Sep. 15, 2011

(51) Int. Cl.
*B25B 13/46* (2006.01)

(52) U.S. Cl. ..... 81/60; 81/63.2

(58) Field of Classification Search ..... 81/60–63.2
See application file for complete search history.

(56) References Cited

U.S. PATENT DOCUMENTS 3,436,992 A * 4/1969 Over et al. ..... 81/63.1
6,516,930 B2 * 2/2003 Chen ..... 192/43.2
6,539,825 B1 * 4/2003 Lin ..... 81/60
6,820,520 B2 * 11/2004 Chen ..... 81/60
7,044,029 B1 * 5/2006 Hopper et al. ..... 81/60
8,051,747 B1 * 11/2011 Tsai ..... 81/63.2
8,104,381 B1 * 1/2012 Chen ..... 81/63.2
2004/0216565 A1 * 11/2004 Chen ..... 81/63.2
2006/0027049 A1 * 2/2006 Arnold ..... 81/60
2006/0236819 A1 * 10/2006 Lee ..... 81/63.1
2007/0289414 A1 * 12/2007 Lee ..... 81/60

* cited by examiner

*Primary Examiner* — Debra S Meislin

(57) ABSTRACT

A ratchet wrench includes a handle including a head including a circular pocket, an internal arcuate recess communicating with the pocket, a circular flange on a lower portion of the pocket, and a C-shaped groove on an upper portion of the pocket, the groove having both ends terminating at the recess; a detent including an arcuate block including an arcuate wing plate extending from one end, and a spring loaded pawl movably seated on the wing plate and besides the arcuate block, the pawl including pawl teeth facing the pocket; a hollow, cylindrical socket rotatably seated on the flange and including external drive teeth on an outer surface, the drive teeth being disengaged from the detent, a toothed drive surface on an inner surface, and a central opening defined by the drive surface; and a split ring mounted on the groove to retain the socket in place.

1 Claim, 3 Drawing Sheets

EASY TO ASSEMBLE RATCHET WRENCH

BACKGROUND OF THE INVENTION

1. Field of the Invention

The invention relates to ratchet wrenches and more particularly to an easy to assemble ratchet wrench.

2. Description of Related Art

A socket wrench is a wrench with interchangeable heads called sockets that attach to a fitting on the wrench, allowing it to turn different sized bolts and other fasteners. The most common form is a hand tool popularly called a ratchet consisting of a handle with a ratcheting mechanism built in, so it can be turned using a back-and-forth motion in cramped spaces. A socket has a cup-shaped fitting with a recess that grips the head of a bolt. The socket snaps onto a male fitting on the handle. The handle supplies the mechanical advantage to provide the torque to turn the socket. The wrench usually comes in a socket set with many sockets to fit the heads of different-sized bolts and other fasteners. The advantage of a socket wrench is that, instead a separate wrench for each of the many different bolt heads used in modern machinery, only a separate socket is needed, saving space.

A conventional ratchet wrench comprises a handle having a head on one end, the head including a hole for rotatably receiving a drive member, a compartment defined in a periphery defining the hole of the head, and a pawl received in the compartment; an anchor mounted in the compartment and including a fulcrum in contact with a wall defining the compartment, and a pair of protrusions on one end for alternately engaging with teeth of the drive member so that the anchor sways but does not slide in the compartment; and a biasing member anchored between the other end of the anchor and a side of the pawl wherein the pawl has a toothed face for engaging with the teeth of the drive member so that when the handle turns idly, the pawl is moved toward the anchor and compresses the biasing member that returns the pawl to a position for engaging with the drive member.

However, a number of drawbacks of the ratchet wrench have been found. In detail, the pair of protrusions of the anchor alternately engaged with the teeth of the drive member during idle rotation of the handle may wear the teeth of the drive member. Further, the anchor may be stuck in the compartment during idle rotation of the handle since there is no means to limit movement of the anchor in the compartment when the anchor is subject to a force exerted by the pawl. Further, the location of the anchor affects operation of the wrench. More specifically, if the swayable anchor is adjacent to the drive member, the swaying angle for the anchor could be too small, and if the swayable anchor is distal the drive member, the swaying angle for the anchor could be too large. This can increase difficulty in assembly of the ratcheting wrench. Further, when the handle is subject to vibrations and/or hammering, the anchor may move to a position prohibiting swaying movement of the anchor.

Thus, the need for improvement still exists.

SUMMARY OF THE INVENTION

It is therefore one object of the invention to provide an easy to assemble ratchet wrench comprising a handle comprising a head including a circular pocket, an internal arcuate recess communicating with the pocket, the recess being smaller than the pocket, a circular flange on a lower portion of the pocket, the flange being spaced from the recess, and a C-shaped groove on an upper portion of the pocket, the groove having both ends terminating at the recess; a detent comprising an arcuate block including an arcuate wing plate extending from one end, and a spring loaded pawl movably seated on the wing plate and besides the arcuate block, the pawl including pawl teeth facing the pocket; a hollow, cylindrical socket rotatably seated on the flange and comprising external drive teeth on an outer surface, the drive teeth being disengaged from the detent, a toothed drive surface on an inner surface, and a central opening defined by the drive surface; and a C-shaped split ring mounted on the groove to retain the socket in place; wherein the pawl teeth are gable teeth; wherein the drive teeth are gable teeth; and wherein the pocket can engage a fastening member to be rotationally driven by the socket.

The above and other objects, features and advantages of the invention will become apparent from the following detailed description taken with the accompanying drawings.

DETAILED DESCRIPTION OF THE INVENTION

Figure 1:
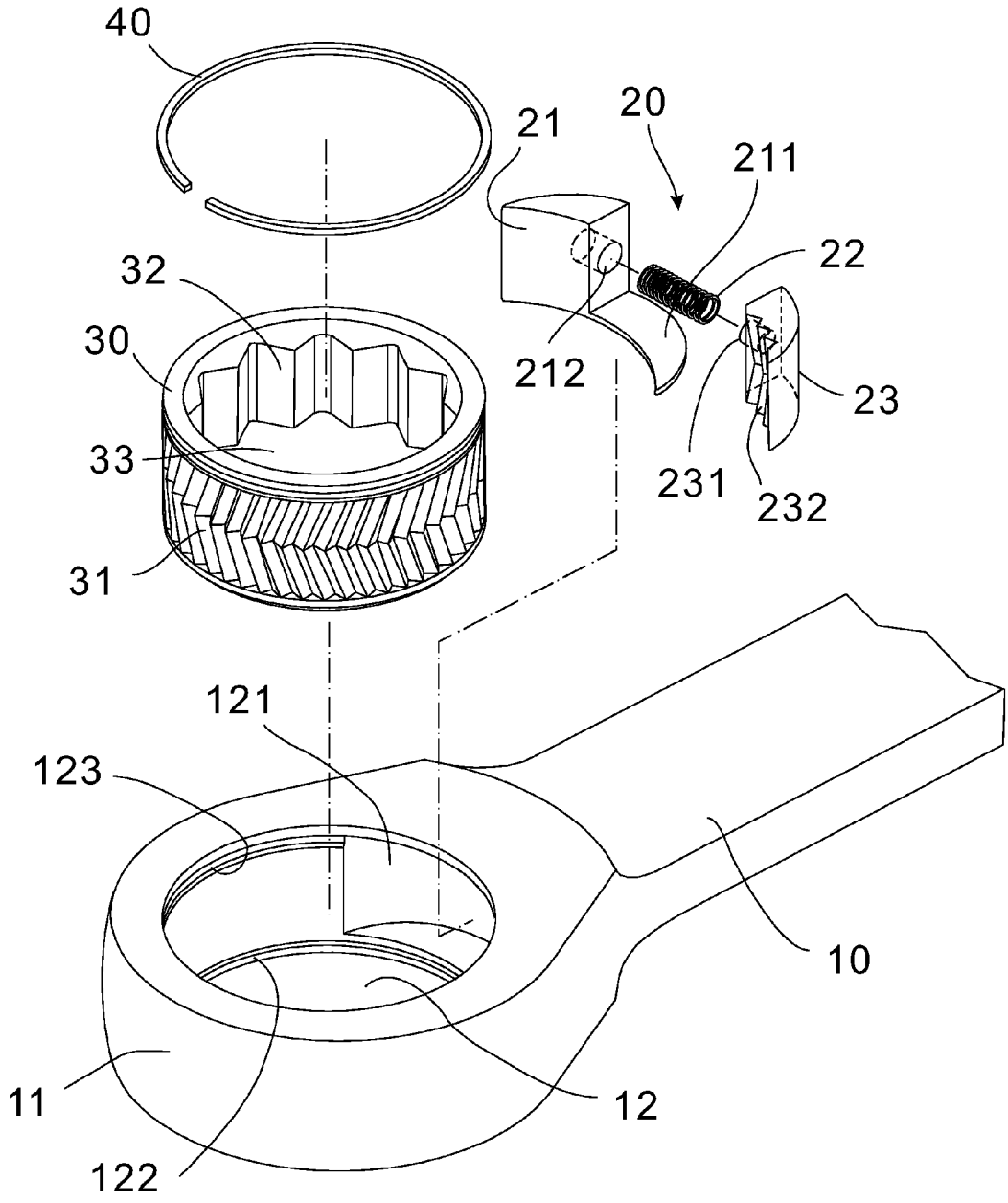
FIG. 1 is an exploded view of a head and adjacent portion of a ratchet wrench according to the invention.
Figure 2:
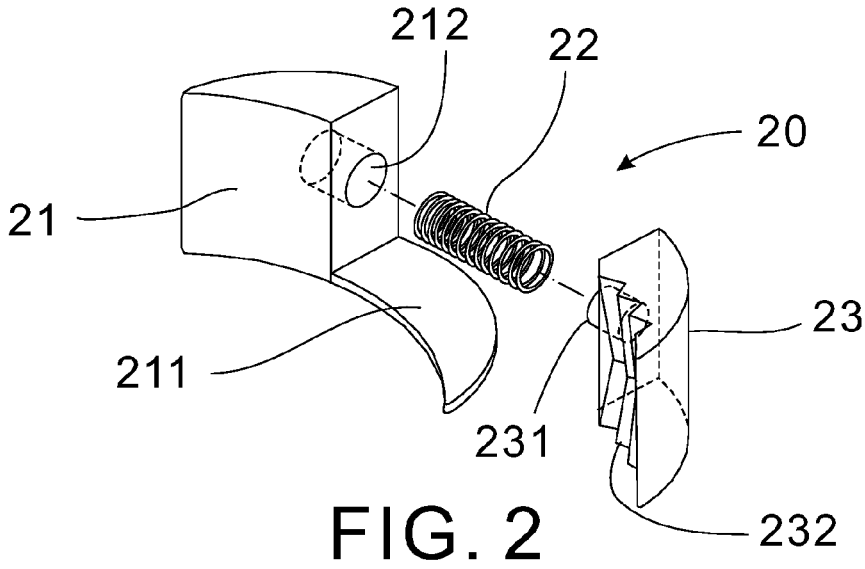
FIG. 2 is an enlarged, exploded view of the detent shown in FIG. 1.

Referring to FIGS. 1 to 5, a ratchet wrench in accordance with the invention comprises the following components as discussed in detail below.

A handle 10 comprises a head 11 including a larger circular pocket 12 and an internal smaller arcuate recess 121 communicating with the pocket 12. On a lower portion of an inner surface of the pocket 12 there is provided a circular flange 122 which is spaced from the recess 121 by a short distance. On an upper portion of the pocket 12 there is provided a C-shaped groove 123 which has both ends terminating at the recess 121.

A detent 20 comprises an arcuate block 21 including an arcuate wing plate 211 extending from one larger end and a cylindrical hole 212 on the larger end; a movable pawl 23 seated on the wing plate 211 and including a cylindrical pin 231 on one larger end facing the hole 212 and pawl teeth 232 on one surface facing the pocket 12 when the detent 20 is mounted in the recess 121, and a torsion spring 22 having one end put on the pin 231 and the other end anchored in the hole 212 to exert a force to push the pawl 23 and the main body of the arcuate block 21 apart from each other. The pawl teeth 232 are gable teeth.

A hollow, cylindrical socket 30 comprises external drive teeth 31 on an outer surface, a toothed drive surface 32 on an inner surface, and a central opening 33. The teeth of the drive surface 32 are also gable teeth.

An assembly process of the invention will be described in detail below. First, the detent 20 is mounted in the recess 121 as a spring loaded member. Next, the cylindrical socket 30 is mounted to rotatably sit on the flange 122 with the drive teeth 31 disengaged from the detent 20. Finally, a C-shaped split ring 40 is mounted on the groove 123 to retain the cylindrical socket 30 in place.

Figure 3:
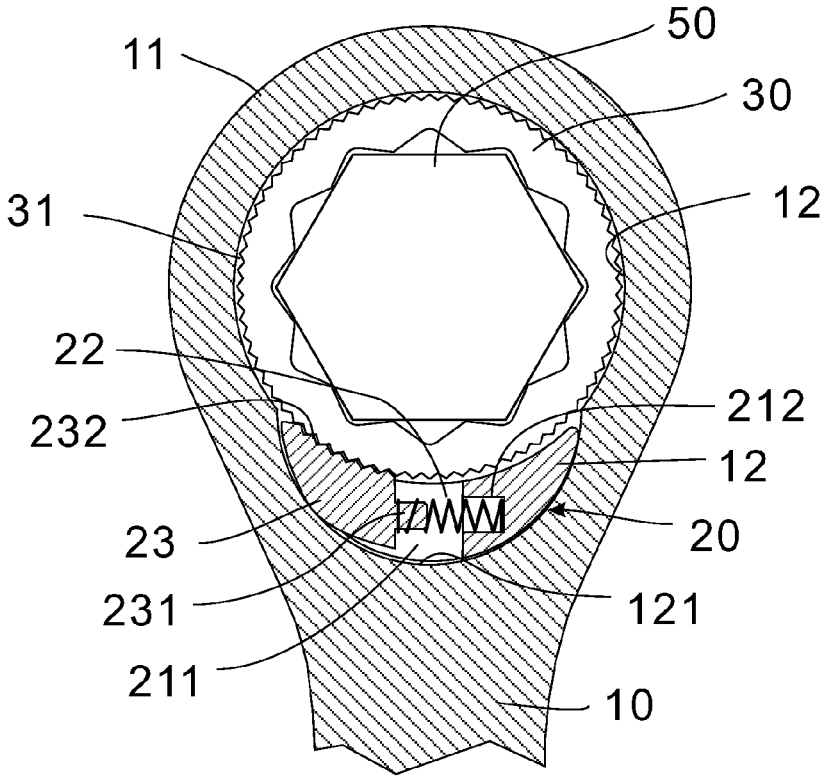
FIG. 3 is a cross-sectional view of the assembled wrench head.
Figure 4:
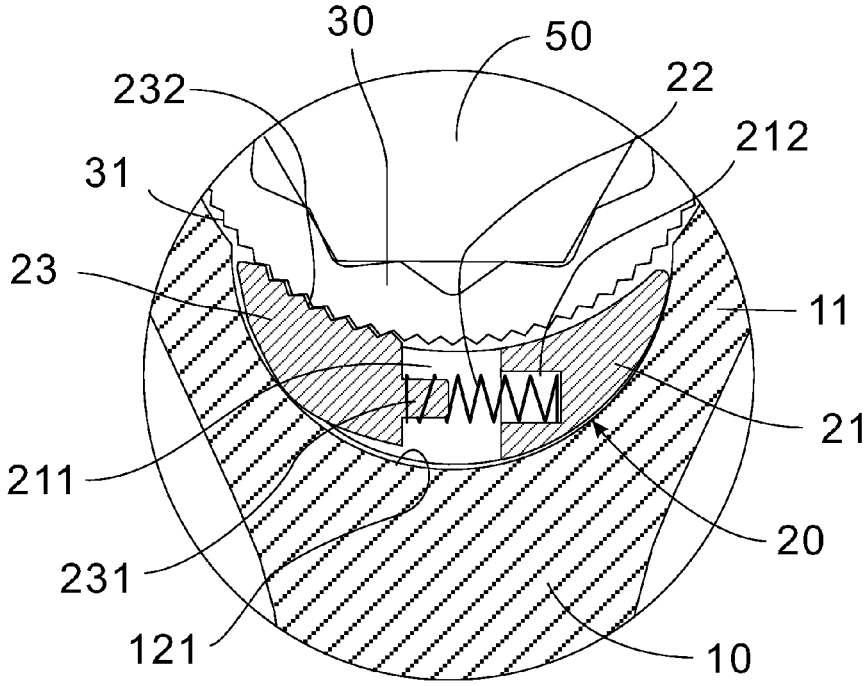
FIG. 4 is an enlarged view of the detent and adjacent components shown in FIG. 3 where a fastener such as nut or bolt may be tightened by the wrench as the head rotates clockwise.

As shown in FIGS. 3 and 4, a user may put the central opening 33 on a fastener (e.g., a nut) 50 with the nut 50 being held in place by the teeth of the drive surface 32. Next, the user may clockwise turn the head 11 to engage the drive teeth 31 with the pawl teeth 232 and the torsion spring 22 is expanded to push the arcuate block 21 and the pawl 23 further away from each other. A further clockwise turning of the head 11 may tighten the nut 50 by the drive surface 32.

Figure 5:
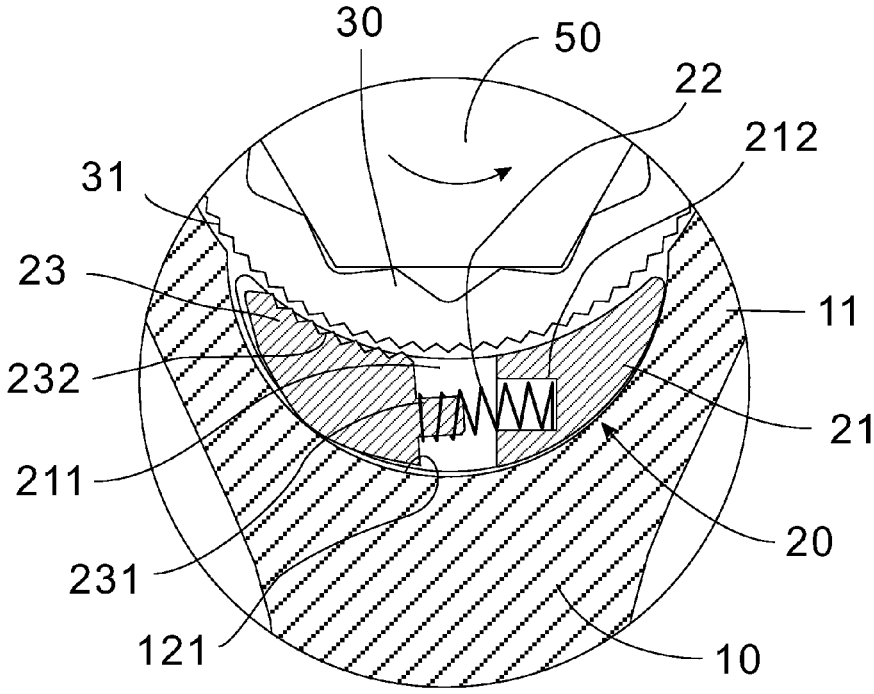
FIG. 5 is a view similar to FIG. 4 showing no force exerted by the wrench due to disengagement of the teeth of the drive gear from the arcuate block as the head rotates counterclockwise.

As shown in FIG. 5, the user may turn the head 11 counterclockwise after the clockwise turning of the head 1 reaches its end. And in turn, the drive teeth 31 are disengaged from the pawl teeth 232 and the torsion spring 22 is compressed to draw the arcuate block 21 and the pawl 23 toward each other. The user may thus further counterclockwise turn the head 11 in an unrestricted manner with the nut 50 being motionless (i.e., idle state). The user may stop turning when the further counterclockwise turning of the head 11 is impossible. This is the end of one turn. A reciprocating motion of the head 11 can tighten the nut 50 without requiring that the wrench be removed and refitted after each turn.

Note that a user may turn the wrench (i.e., the head 11) upside down and perform the steps discussed in above two paragraphs to loosen a fastener.

It is envisaged by the invention that the ratchet wrench is easy to assemble and that the manufacturing cost can be reduced greatly. Also, the ratcheting operation is easy.

While the invention has been described in terms of preferred embodiments, those skilled in the art will recognize that the invention can be practiced with modifications within the spirit and scope of the appended claims.

What is claimed is:

1. A ratchet wrench comprising:

a handle comprising a head including a circular pocket, an internal arcuate recess communicating with the pocket, the recess being smaller than the pocket, a circular flange on a lower portion of the pocket, the flange being spaced from the recess, and a C-shaped groove on an upper portion of the pocket, the groove having both ends terminating at the recess;

a detent comprising an arcuate block including an arcuate wing plate extending from one end, and a spring loaded pawl movably seated on the wing plate and besides the arcuate block, the pawl including pawl teeth facing the pocket;

a hollow, cylindrical socket rotatably seated on the flange and comprising external drive teeth on an outer surface, the drive teeth being disengaged from the detent, a toothed drive surface on an inner surface, and a central opening defined by the drive surface; and a C-shaped split ring mounted on the groove to retain the socket in place;

wherein the pawl teeth are gable teeth;

wherein the drive teeth are gable teeth;

wherein the pocket can engage a fastening member to be rotationally driven by the socket; and wherein the socket is always operable for ratcheting action in one direction of rotation of the handle about the fastening member.

* * * * *